US009476330B2

(12) United States Patent
Kojima

(10) Patent No.: US 9,476,330 B2
(45) Date of Patent: Oct. 25, 2016

(54) ELECTRO-MAGNETIC VALVE DRIVER

(71) Applicant: DENSO CORPORATION, Kariya, Aichi-pref. (JP)

(72) Inventor: Keita Kojima, Toyoake (JP)

(73) Assignee: DENSO CORPORATION, Kariya (JP)

( * ) Notice: Subject to any disclaimer, the term of this patent is extended or adjusted under 35 U.S.C. 154(b) by 37 days.

(21) Appl. No.: 14/551,388

(22) Filed: Nov. 24, 2014

(65) Prior Publication Data

US 2015/0152820 A1 Jun. 4, 2015

(30) Foreign Application Priority Data

Nov. 29, 2013 (JP) ..... 2013-247871

(51) Int. Cl.

| | |
|---|---|
| ***F02D 41/00*** | (2006.01) |
| ***F01L 9/04*** | (2006.01) |
| ***F02D 41/20*** | (2006.01) |
| *F02D 41/22* | (2006.01) |

(52) U.S. Cl.

CPC ..... *F01L 9/04* (2013.01); *F02D 41/20* (2013.01); *F01L 2009/0401* (2013.01); *F02D 41/22* (2013.01); *F02D 2041/2006* (2013.01); *F02D 2041/2027* (2013.01); *F02D 2041/2044* (2013.01); *F02D 2041/2051* (2013.01); *F02D 2041/2058* (2013.01); *F02D 2041/2089* (2013.01)

(58) Field of Classification Search

CPC ..... F02D 41/221; F02D 2041/227; F02D 2041/2006; F02D 2041/2086; F02D 2041/2089; F02D 2041/2093

USPC ..... 123/479, 490

See application file for complete search history.

(56) References Cited

U.S. PATENT DOCUMENTS

| | | | | |
|---|---|---|---|---|
| 6,102,008 | A | 8/2000 | Maeda et al. | |
| 6,505,609 | B1 * | 1/2003 | Biester | F02D 41/20 123/479 |
| 7,621,259 | B2 * | 11/2009 | Mayuzumi | F02D 41/20 123/490 |

(Continued)

FOREIGN PATENT DOCUMENTS

| | | | |
|---|---|---|---|
| JP | H10-047139 | A | 2/1998 |
| JP | 2001-351814 | A | 12/2001 |

(Continued)

OTHER PUBLICATIONS

Office Action mailed Nov. 17, 2015 in the corresponding JP application No. 2013-247871 (with English translation).

*Primary Examiner* — Erick Solis

(74) *Attorney, Agent, or Firm* — Posz Law Group, PLC

(57) ABSTRACT

An electromagnetic valve driver, in normal operation, supplies peak current from a capacitor to a coil of an injector by turning ON a transistor on a downstream side of the coil and a discharge transistor that discharges electricity from the capacitor to the coil. Thereafter, the driver supplies constant current to the coil by an ON-OFF control of a transistor disposed between a battery and an upstream side of the coil until an end of the electricity supply period. When an open failure of the discharge transistor is detected, the driver controls the current to prevent a voltage rise of the capacitor to reduce flyback energy collected from a downstream side of the coil by the capacitor based on a transistor OFF timing delay scheme, in which an OFF timing of a transistor is delayed by a preset delay time from a normal OFF timing thereof.

5 Claims, 8 Drawing Sheets

(56) References Cited

U.S. PATENT DOCUMENTS

| | | | | |
|---|---|---|---|---|
| 8,478,509 | B1 * | 7/2013 | Kirkpatrick | F02D 41/20 123/479 |
| 8,694,228 | B2 * | 4/2014 | Kitamura | F02D 41/20 123/479 |
| 2005/0051139 | A1 * | 3/2005 | Slater | F02D 41/20 123/479 |
| 2008/0289607 | A1 | 11/2008 | Mayuzumi et al. | |
| 2008/0316670 | A1 * | 12/2008 | Matsuura | F02D 41/20 361/152 |
| 2009/0107469 | A1 | 4/2009 | Takahashi et al. | |
| 2009/0121724 | A1 * | 5/2009 | Perryman | F02D 41/2096 324/522 |
| 2014/0190453 | A1 * | 7/2014 | Qiao | F02M 51/00 123/478 |

FOREIGN PATENT DOCUMENTS

| | | | |
|---|---|---|---|
| JP | 2002-303185 | A | 10/2002 |
| JP | 2007-66978 | A * | 3/2007 |
| JP | 2007-066978 | A | 3/2007 |
| JP | 2012-122462 | A | 6/2012 |

* cited by examiner

ELECTRO-MAGNETIC VALVE DRIVER

CROSS REFERENCE TO RELATED APPLICATION

The present application is based on and claims the benefit of priority of Japanese Patent Application No. 2013-247871, filed on Nov. 29, 2013, the disclosure of which is incorporated herein by reference.

TECHNICAL FIELD

The present disclosure generally relates to a device for driving an electro-magnetic valve and a driver device that discharges electric energy charged in a capacitor to a coil of the electro-magnetic valve to improve a responsiveness of the electro-magnetic valve and to collect a flyback energy generated at an end of an electricity supply time of the coil.

BACKGROUND INFORMATION

Conventionally, in a fuel injector for an engine, an electro-magnetic valve has a coil that is opened by receiving a supply of electricity to the coil.

A fuel injection control device controls an injector to control an injection of fuel. The fuel injection control device also controls a fuel injection amount and timing by controlling an electricity supply timing of electricity supplied to the coil.

In such a fuel injection control device, a charge voltage for charging a capacitor is set to a target voltage by boosting the electricity supply voltage with a booster circuit and by charging the capacitor at the boosted voltage. Then, at a time of starting the electricity supply to the coil, a switch that connects the capacitor to an upstream side of the coil (hereinafter "discharge switch") is switched ON to supply a peak current from the capacitor to the coil for a quick opening of the valve in the injector. Thereafter, a constant electric current is supplied to the coil for keeping the injector in a valve-open state until the end timing of the electricity supply time. Further, the fuel injection control device collects, to the above-mentioned capacitor via a diode, the flyback energy (i.e., a counter-electromotive energy) that is generated at the end timing of the electricity supply time for supplying electricity to the coil. Such an arrangement is disclosed in a patent document 1 (i.e., Japanese Patent Laid-Open No. 2002-303185).

In the conventional fuel injection control device, when an open failure which disables a switch-ON of the discharge switch, the following problems are caused.

Although a discharge current from the capacitor cannot be supplied to the coil of the injector when an open failure is caused in the discharge switch, the valve opening operation of the injector can still be performed by using a constant current circuit that supplies a constant electric current for the coil.

However, even in such an open failure time, the flyback energy generated at the end timing of the electricity supply time for supplying electricity to the coil will be collected to the capacitor via the above-mentioned diode, and electric discharge for discharging electricity from the capacitor will not be performed since the discharge switch suffers the open failure.

Therefore, the charge voltage of the capacitor will rise due to the flyback energy collected from the coil at every drive time of the injector (i.e., more specifically, at the end timing of the electricity supply time for supplying electricity to the coil each time the injector is driven). Thus, the charge voltage of the capacitor will reach an abnormal voltage that leads to the damage of other circuit elements (i.e., other components other than the discharge switch) immediately, which means that the fuel injection control device soon suffers from multi-component failure.

When the multi-component failure is caused by the abnormal rise of the charge voltage, there is no guarantee of a normal drive operation of the injector, which results in the stopping of the vehicle engine and a hindrance to the ability of the vehicle to travel.

Alternatively, for example, to prevent the multi-component failure, the drive of the injector may be intentionally stopped when the charge voltage of the capacitor is detected to be exceeding a predetermined value. However, such a configuration (i.e., a forceful stop of the injector) will yield the same result. That is, when the discharge switch suffers from the open failure, the charge voltage of the capacitor exceeds the above-mentioned predetermined value immediately. As a result, the engine stops and the ability of the vehicle to travel is hindered.

Therefore, when an open failure is caused in the discharge switch of the conventional fuel injection control device, a retreat travel of the vehicle under control of the driver is hindered, which affects the driver's ability to retreat to a safe place.

SUMMARY

It is an object of the present disclosure to provide a device for driving an electro-magnetic valve, in case that such a device suffers from an open failure of a discharge switch that serves as a part of a discharge path/circuit for discharging electricity from a capacitor to a coil of the electro-magnetic valve, which is enabled to continue a drive control of the valve by preventing a continuation of rise of the charge voltage that charges the capacitor.

In an aspect of the present disclosure, an electro-magnetic valve driver has a downstream switch disposed in series on a downstream side of a coil in an electric current path that supplies an electric current to the coil of an electro-magnetic valve, and also has a first upstream switch disposed in series at a position between (i) an electricity supply line to which an electricity supply voltage is applied and (ii) an upstream of the coil in the electric current path.

Further, the electro-magnetic valve driver has a capacitor storing an electric energy that is to be discharged to the coil, a charger charging electricity for the capacitor to boost/raise a charge voltage of the capacitor to a target voltage that is higher than the electricity supply voltage, a second upstream switch connecting the capacitor to an upstream side of the coil in the electric current path, a flowback section flowing the electric current back to the capacitor when the first upstream switch is switched from ON to OFF during a switch ON period of the downstream switch, and an electricity supply time setting section setting an electricity supply time for supplying the electricity to the coil.

Further, in the electro-magnetic valve driver, an electric current controller is provided, for switching the downstream switch to ON during the electricity supply time set by the electricity supply time setting section while (1) supplying a peak electric current from the capacitor to the coil for a quick operation of the electro-magnetic valve by switching the second upstream switch to ON at a start timing of the electricity supply time, (2) after supplying the peak electric current, supplying a constant electric current that is smaller than the peak electric current to the coil by (a) switching the second upstream switch to OFF and (b) performing a first upstream switch ON-OFF control, and (3) after an end timing of the electricity supply time, ending the first upstream switch ON-OFF control and switching the first upstream switch to OFF.

Further, in the electro-magnetic valve driver, a flyback energy of the coil which is generated by a switch OFF of the downstream switch and the first upstream switch is collected by a collector section to the capacitor.

Further, in particular, the electro-magnetic valve driver has a failure detector detecting an open failure of the second upstream switch which disables a switch ON of the second upstream switch, and also has a delay section.

The delay section delays a switch OFF timing of the downstream switch from the end timing of the electricity supply time by a delay time of preset amount when the open failure is detected by the failure detector.

When the delay section delays the OFF timing of the downstream switch from the end timing of the electricity supply time, an amount of the flyback energy collected by the flowback section to the capacitor at the end timing of the electricity supply time decreases.

That is, in a normal time in which the delay section does not function, the downstream switch is switched OFF at the end timing of the electricity supply time, and an ON-OFF control of the first upstream switch is ended, thereby keeping the first upstream switch in an OFF state and causing the coil to generate a large flyback energy.

On the other hand if only keeping the downstream switch switched to ON for a predetermined period after the end timing of the electricity supply time, the circuit during such a delay time is put in a state in which "the downstream switch=ON" and "the first upstream switch=OFF" and the flowback section flows the electric current back to the coil. Then, by such a flowback of the electric current, the energy accumulated in the coil is consumed, and by the time when the downstream switch is switched to OFF, the coil is controlled to one of the following states, i.e., (a) the energy will not be generated by the coil any more, or (b) the amount of the generated energy by the coil is only nominal, if any.

Therefore, when open failure is caused in the second upstream switch which forms a discharge path from the capacitor to the coil according to the electro-magnetic valve driver of the present disclosure, the flyback energy collected by the collector section via the collector section to the capacitor is reduced, for the prevention of continuation of the rise of the charge voltage of the capacitor. Therefore, a drive control of the electro-magnetic valve can be continued for a long time, without damaging other components other than the second upstream switch. Further, there is no need to add a circuit for a forceful discharge of the capacitor.

Numerals in a parenthesis in the claims show a correspondence relationship with concrete examples disclosed in the embodiment which serves as one of many modes of the disclosure, which do not at all limit a technical scope of the present disclosure.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Figure 1:
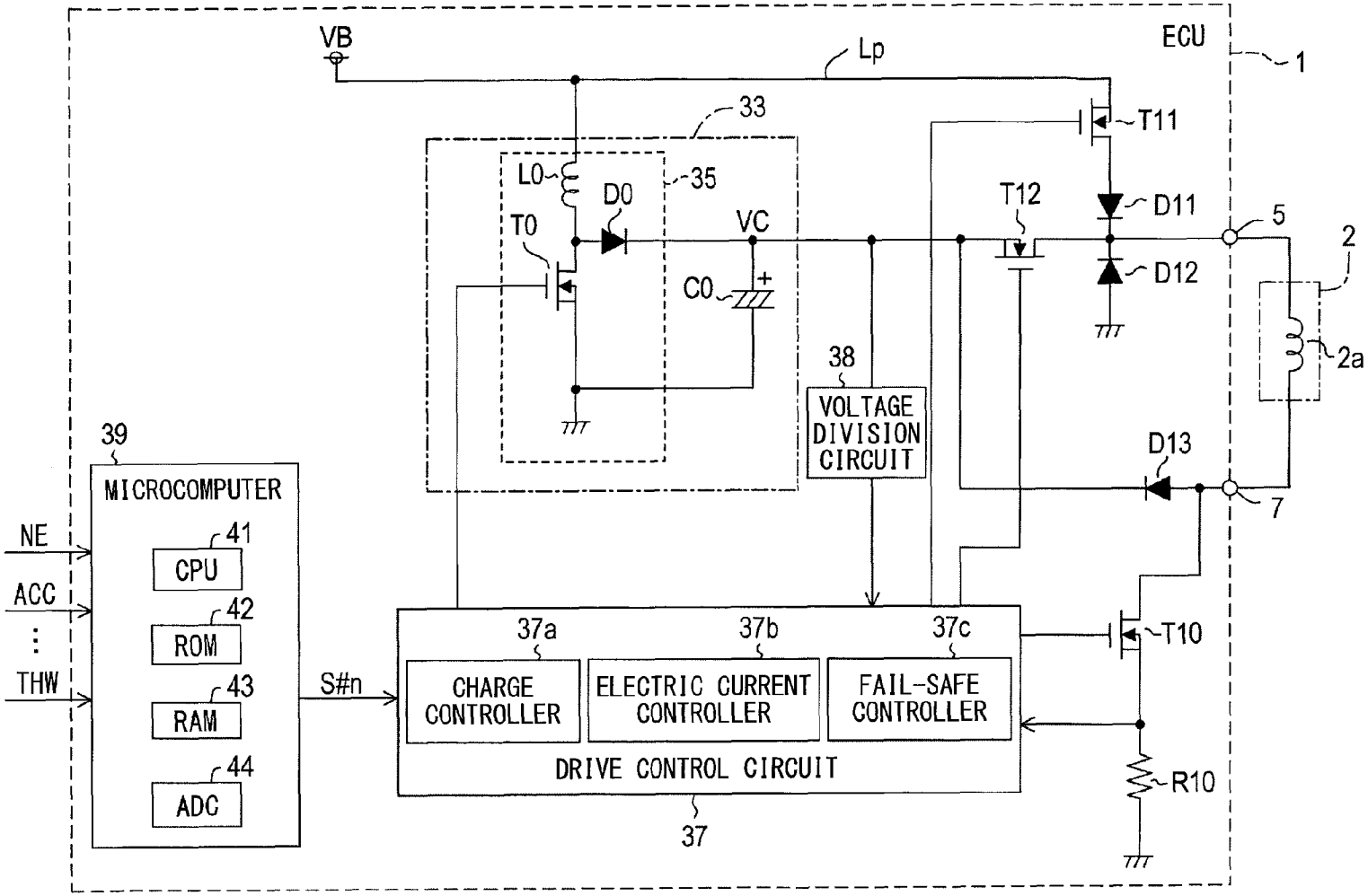
FIG. 1 is a block diagram of a fuel injection control device (ECU) in a first embodiment of the present disclosure.

In the following, an embodiment of the fuel injection control device serving as an electro-magnetic valve driver is described with reference to the drawing.

The fuel injection control device (i.e., henceforth an ECU) of the present embodiment drives an injector, which may be an electro-magnetic valve which injects and provides fuel to each of four cylinders (i.e., cylinder #1 to cylinder #4) in the multi-cylinder engine of a vehicle. The ECU controls a fuel injection amount and a fuel injection timing of each of the four cylinders (i.e., cylinder #1 to cylinder #4) by controlling an electricity supply time and an electricity supply timing (i.e., when and how long) for supplying electricity to a coil of the injector.

Further, in the present embodiment, although a transistor (i.e., a switching element) serving as a switch is, for example, MOSFET, the transistor may also be another device, such as a bipolar transistor, an IGBT (i.e., Insulated Gate Bipolar Transistor) and the like.

First Embodiment

As shown in FIG. 1, an ECU 1 is provided with a terminal 5 to which one end (i.e., an upstream side) of a coil 2*a* of an injector 2, which is a driving object of the driver device, a terminal to which the other end of the coil 2*a* (i.e., a downstream side) is connected, a transistor T10 having one of its output terminals connected to the terminal 7, an electric current detecting resistor R10 connected between the other output terminal of the transistor T10 and a ground line. The ground line has a standard voltage equal to 0 volt.

The injector 2, when receiving a supply of electricity to the coil 2*a*, injects fuel by a move of a valve body (i.e., a so-called nozzle needle) to an open valve position, that is, by an opening of a valve. Further, when the electricity supply to the coil 2*a* is interrupted, the valve body returns to its original position (i.e., the valve is closed) and the injection of the fuel is stopped.

In FIG. 1, only one of the four injectors 2 is shown, which is in a cylinder #n of the four cylinders (n: 1 to 4). The following description is about a drive of that one of four cylinders. More practically, one terminal 5 serves four injectors 2 in respective cylinders, and the coils 2*a* in respective cylinders are connected to that one terminal 5. The terminal 7 and the transistor T10 are provided in four sets, i.e., one set for one cylinder. The transistor T10 is a switching element for selecting an injector 2, which is a driving object of a drive by the ECU at the moment and may also be an injecting cylinder in other words, and is thus called a cylinder selection switch.

The ECU 1 is further provided with a transistor T11 serving as a constant electric current switching element which has one of its output terminals connected to an electricity supply line Lp that has a supply of a battery voltage VB (i.e., a voltage of a positive terminal of an in-vehicle battery), a reverse current protection diode D11 having its anode connected to the other output terminal of the transistor T11 and its cathode connected to the above-mentioned terminal 5, an electric current flowback diode D12 having its anode connected to the ground line and its cathode connected to the terminal 5, and a booster circuit 33.

The booster circuit 33 is a booster type DC/DC converter, and is provided with a capacitor C0 in which the electric energy discharged from the coil 2*a* is accumulated and a charge circuit 35 which boosts the battery voltage VB for the charging of the capacitor C0.

The charge circuit 35 is provided with a coil L0 having its one end connected to the electricity supply line Lp, a transistor T0 disposed in series on a path the other end of the coil L0 and the ground line, and a reverse electric current protection diode D0 having its anode connected to a path between the other end of the coil L0 and an L0 side terminal (i.e., a drain) of the transistor T0.

The capacitor C0 is disposed in series on a path between a cathode of the diode D0 and the ground line. Though the capacitor C0 in the present embodiment is an aluminum electrolytic condenser, for example, the capacitor of other type may also be usable.

In the booster circuit 33, when the transistor T0 is switched ON and OFF, a flyback voltage (i.e., a reverse electromotive voltage) that is higher than the battery voltage VB is generated at a junction point between the coil L0 and the transistor T0, and the capacitor C0 is charged by such a flyback voltage via the diode D0. Therefore, the capacitor C0 is charged by a voltage higher than the battery voltage VB.

The ECU 1 is further provided with a transistor T12 serving as an electricity discharge switching element for electricity discharge which connects a positive side of the capacitor C0 to the terminal 5, an energy collecting diode D13 for collecting energy which has the anode connected to the terminal 7 and its cathode connected to the positive side of the capacitor C0, a drive control circuit 37 which controls the transistors T0, T10, T11, and T12, a voltage division circuit 38 which divides a voltage VC on a positive side of the capacitor C0 (i.e., a charge voltage of the capacitor C0, and is called a capacitor voltage hereafter) by a predetermined ratio for inputting the divided voltage to the drive control circuit 37, and a microcomputer 39.

The drive control circuit 37 is an IC, for example, and is provided with a charge controller 37*a* which controls the transistor T0 of the charge circuit 35, and an electric current controller 37*b* which controls the electric current supplied to the coil 2*a* by controlling the transistors T10 and T11, and T12, and a fail-safe controller 37*c* which performs a fail-safe operation at a time of an open failure that disables a switch ON of the transistor T12.

The microcomputer 39 is provided with a CPU 41 which executes a program, a ROM 42 which stores a program, constant data and the like, a RAM 43 which stores calculation results by the ROM 42, an A-D converter (ADC) 44, and the like.

Further, the microcomputer 39 receives various inputs, such as a signal of an engine rotation speed NE (i.e., engine rotation speed), a signal of an accelerator opening ACC by an operation of the driver of the vehicle, a signal of an engine cooling water temperature THW, and the like.

Further, based on the operation state of the engine detected by the various input signals, the microcomputer 39 generates an injection instruction signal for each of the four cylinders, and outputs the signal to the drive control circuit 37.

The injection instruction signal instructs the coil 2*a* of the injector 2 to receive electricity while the signal is in an active level (i.e., in HIGH level in the present embodiment, for example), that is, opens the valve of the injector 2. In other words, the microcomputer 39 sets, for each of the four cylinders, an electricity supply time for the coil 2*a* of the injector 2, and puts the injection instruction signal of the subject cylinder in HIGH level only during the electricity supply time.

In the drive control circuit 37, the capacitor voltage VC is detected based on the voltage inputted from the voltage division circuit 38. Then, the charge controller 37*a* of the drive control circuit 37 controls, i.e., switches ON and OFF, the transistor T0 of the charge circuit 35 so that the capacitor voltage VC becomes the target voltage when all injection instruction signals for every cylinder from the microcomputer 39 are put in LOW level (i.e., when no fuel injection is performed). Then, if the capacitor voltage VC is equal to or becomes greater than the target voltage, the charge controller 37*a* keeps the transistor T0 in a switched OFF state, and stops the charging of the capacitor C0. The target voltage is higher than the battery voltage, for example, which is 65 V.

Next, a normal control operation of the electric current controller 37*b* in the drive control circuit 37 is described with reference to FIG. 2.

Figure 2:
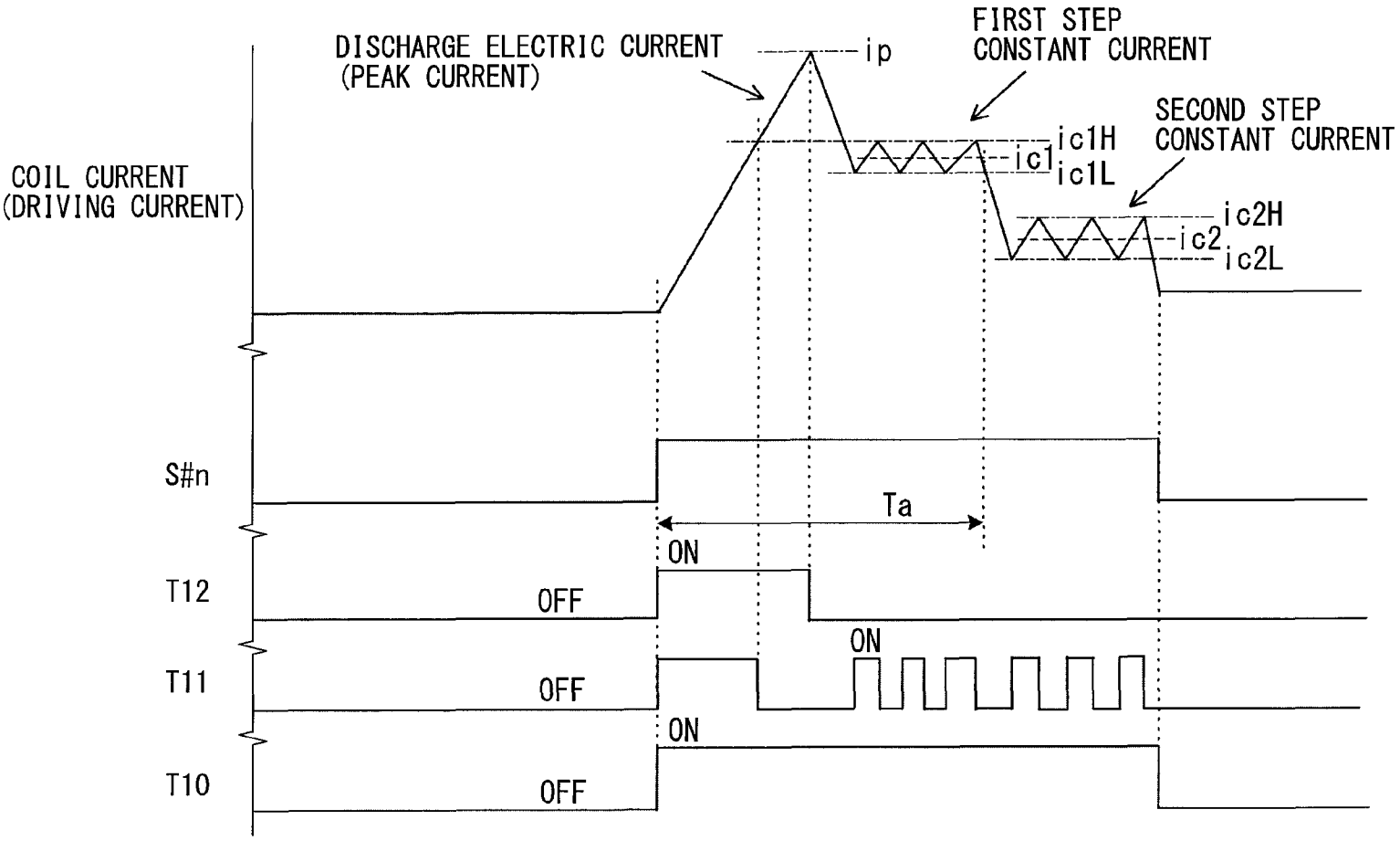
FIG. 2 is a time chart of a normal control operation of an electric current controller.

As shown in FIG. 2, after switching of an injection instruction signal S#n of an n-th cylinder #n outputted from the microcomputer 39 to HIGH level, the electric current controller 37*b* keeps, in an ON state, the transistor T10 that corresponds to the injector 2 of the n-th cylinder #n during such a HIGH level period of the injection instruction signal S#n. Further, when the injection instruction signal S#n becomes HIGH, the electric current controller 37*b* also switches ON the transistor T12.

In such manner, the positive side of the capacitor C0 is connected to the terminal 5, and discharge of the electricity is caused from the capacitor C0 to the coil 2*a*, and the electricity supply to the coil 2*a* is started by such an electric discharge.

After the switching ON of the transistor T12, the electric current controller 37*b* detects, by detecting a voltage in the resistor R10, an electric current in the coil 2*a* (i.e., the electric current may also be a driving current of the injector 2, and is thus called a coil current hereafter), and switches OFF the transistor T12 when detecting that the coil current becomes a target maximum value ip (e.g., 12 A) at the start timing of the electricity supply.

In such manner, at the start timing of the electricity supply to the coil 2*a*, the electric energy accumulated in the capacitor C0 is discharged to the coil 2*a*. In this example, by the time the electric current reaches the target maximum value ip, the discharge electric current from the capacitor C0 to the coil 2*a* is a peak current for performing a quick valve opening operation of the injector 2. In this case, a switching ON period of the transistor T12 may also be configured, for example, as a constant period.

After switching OFF of the transistor T12, the electric current controller 37*b* performs a constant electric current control which switches ON/OFF the transistor T11 so that the coil current detected as the voltage in the electric current detecting resistor R10 becomes a constant electric current that is smaller than the above-mentioned target maximum value ip.

More practically, the electric current controller 37*b* performs an ON-OFF control of the coil current by the switching ON and OFF of the transistor T11 for a preset period Ta after an injection instruction signal S#n switched to HIGH timing (i.e., after the start timing of the electricity supply), in which (i) the transistor T11 is switched ON when the coil current is detected to be equal to or lower than a first lower threshold ic1L, and (ii) the transistor T11 is switched OFF when the coil current is detected to be equal to or higher than a first upper threshold ic1H. Then, the electric current controller 37*b* performs an ON-OFF control of the coil current by the switching ON and OFF of the transistor T11 for a period that is defined as the one after the above-described preset period Ta and until the injection instruction signal S#n is switched to LOW level, in which (i) the transistor T11 is switched ON when the coil current is detected to be equal to or lower than a second lower threshold ic2L, and (ii) the transistor T11 is switched OFF when the coil current is detected to be equal to or higher than a second upper threshold ic2H.

In such case, the above-described thresholds and the target maximum value fulfill the following high-low relationship. That is, as shown in FIG. 2, "ip>ic1H>ic1L>ic2H>ic2L."

With such a constant electric current control, when the coil current falls from the target maximum value ip to be equal to or lower than the first lower threshold id L, ON and OFF of the transistor T11 is repeated, and an average value of the coil current is maintained in a range between ic1H and ic1L, i.e., maintained as a first constant current id for the preset period Ta after the start timing of the electricity supply. Then, for a period after the above-described preset period Ta and until the injection instruction signal S#n is switched to LOW level (i.e., by the end timing of the electricity supply), the average value of the coil current is maintained in a range between ic2H and ic2L, i.e., maintained as a second constant current ic2 (<ic1).

That is, in the above example, the constant current supplied to the coil 2*a* is switched in two steps, from the first constant current id (e.g., 6 A) to the second constant current ic2 smaller than ic2 (e.g., 4 A). The first constant current id is an electric current (i.e., so-called "pick-up current") for securely putting the injector 2 in a valve-open state, and the second constant current ic2 is the minimum current (i.e., so-called "hold current") required for maintaining the valve-valve-open state of the injector 2.

At the time of switching ON of the transistor T11, the electric current flows from the electricity supply line Lp to the coil 2*a* via the transistor T11 and the diode D11, and the electric current flows back from the ground line via the diode D12 (to it) at the time of switching OFF of the transistor T11.

Further, as shown in the second row from the bottom in FIG. 2, for a while after the injection instruction signal S#n is switched to HIGH (i.e., for a short time until the coil current reaches the first upper threshold ic1H), the transistor T11 is switched to ON by the above-described control.

Thereafter, when the injection instruction signal S#n from the microcomputer 39 is switched from HIGH level to LOW level, the electric current controller 37*b* switches OFF the transistor T10, and ends the ON-OFF control (i.e., the constant electric current control) of the transistor T11, and holds the transistor T11 in the OFF state.

Then, the electricity supply to the coil 2*a* stops, the injector 2 closes the valve, and the injection of fuel by the injector 2 is finished.

Further, when the injection instruction signal S#n is switched to LOW level and both of the transistor T10 and the transistor T11 are switched OFF, the flyback energy is generated in the coil 2*a*, which is then collected in a form of electric current by the capacitor C0 through the diode D13 which serves as an energy collecting path. The electric current which flows to the capacitor C0 through the diode D13 is called as a regeneration current (refer to the second row from the bottom in FIG. 3).

Note that other injectors 2 in other cylinders other than the above-described n-th cylinder #n are driven in the same manner.

Next, the fail-safe controller 37*c* of the drive control circuit 37 is described.

First, the reason why the fail-safe controller 37*c* is used is described.

When the open failure disabling a switch ON is caused in the discharge transistor T12, the coil 2*a* of the injector 2 will not receive the capacitor voltage VC. However, the battery voltage VB can still be supplied to an upstream side circuit (i.e., to a circuit including the transistor T11 and the diodes D11, D12) that flows a constant current to the coil 2*a*. Therefore, the injector 2 can still be driven by the battery voltage VB for the valve-opening operation, although valve-opening responsiveness falls from the normal time.

Figure 3:
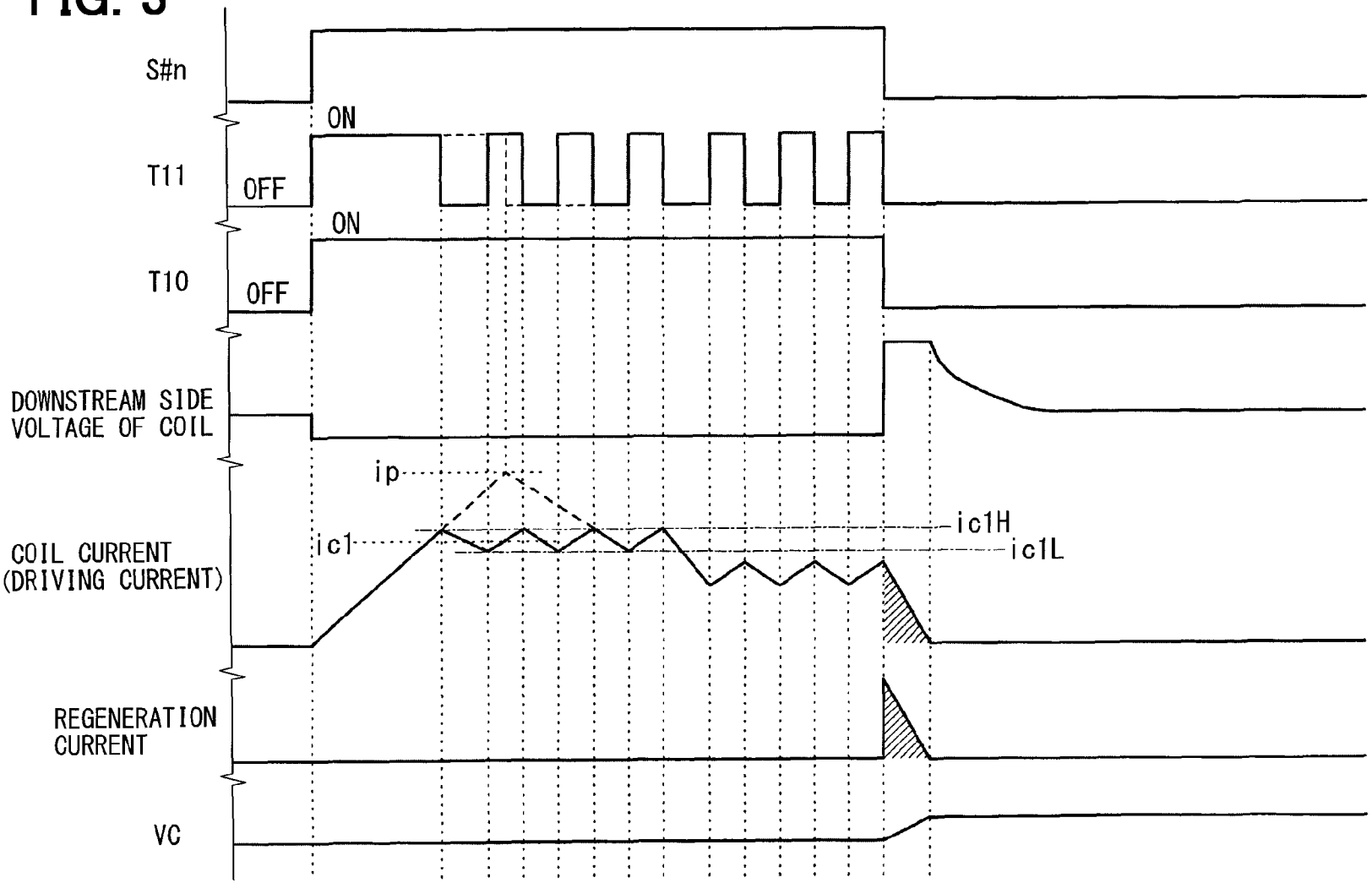
FIG. 3 is an illustration of a problem.

FIG. 3 shows transistor operations, regarding the transistors T10, T11, for the electricity supply to the coil 2*a* at an open failure time of the transistor T12 under the normal control (i.e., operation described in FIG. 2) of the electric current controller 37*b*, together with other conditions.

In FIG. 3, a "downstream side voltage of the coil" is the voltage of the terminal 7. Such a notation also applies to the other drawings.

As shown in FIG. 3, since the above-mentioned first constant current ic1 (i.e., a pick-up current) can be supplied to the coil 2*a* at least, the valve opening operation of the injector 2 is performable. Further, as an example of a special mode of control that is performed for handling an open failure of the transistor T12, which is shown in FIG. 3 as a dotted line wave form in the "coil current" row, a first switch ON of the transistor T11 after the start timing of the electricity supply may be continued by the time when the coil current reaches a certain target value that is higher than the first upper threshold ic1H (i.e., until the coil current reaches the target maximum value ip mentioned above in this case).

According to such a special mode of control, a delay of the valve-opening response of the injector 2 due to the open failure of the transistor T12 is decreased/reduced.

However, as shown in FIG. 3 (i.e., especially in the second row from the bottom), even when the injector 2 is driven only by the battery voltage VB, at the end timing of the electricity supply to the coil 2*a*, the flyback energy of the coil 2*a* generated by the switching OFF of the transistor T10 is collected via the diode D13 to the capacitor C0. Further, since the open failure is caused in the transistor T12, discharge of electricity from the capacitor C0 will not be performed.

Therefore, even after the capacitor voltage VC has reached the target voltage by the charge controller 37*a*, the capacitor voltage VC continues to go up. The larger the coil current at the switch OFF time of the transistor T10 is, the larger the regeneration current which flows to the capacitor C0 via the diode D13 becomes, which results in a larger rise of the capacitor voltage VC. In such a case, when the regeneration current flows to the capacitor C0 via the diode D13, the downstream side voltage of the coil 2*a* (i.e., a voltage of the terminal 7) is lower than the capacitor voltage VC by a forward voltage of the diode D13 (refer to the fourth row in FIG. 3).

Figure 4:
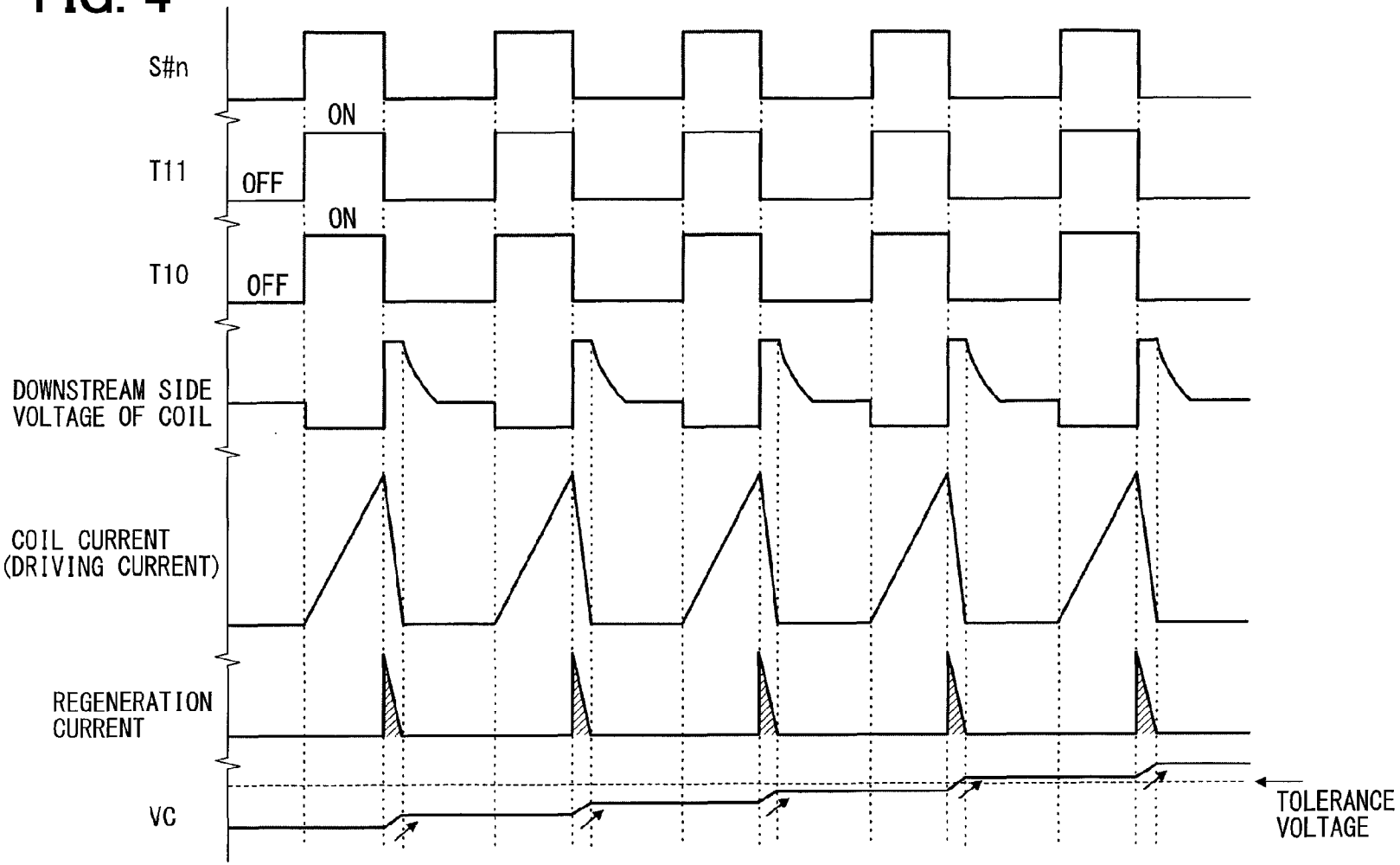
FIG. 4 is another illustration of the problem.

Therefore, when the transistor T12 suffers from the open failure, the capacitor voltage VC goes up every time the injector 2 is driven (i.e., at the end timing of the electricity supply to the coil 2*a*, more specifically) as shown in FIG. 4. Although, in FIG. 4, (i) the timing of switching the injection instruction signal S#n to LOW level and (ii) the timing of first switching OFF of the transistor T11 based on the detected value of the coil current are depicted as the same timing for illustration purposes, a HIGH period of the injection instruction signal S#n is set according to an engine operational state. The same applies also to FIG. 8 that is mentioned later.

Then, as shown in the bottom row of FIG. 4, when the capacitor voltage VC goes up to exceed the tolerance voltage (e.g., 80 V) of the circuit element (e.g., the diodes D0, D13) on which the capacitor voltage VC is directly applied, the circuit element will break down. That is, the secondary failure is caused. Further, for example, when a short-circuit failure is caused in the diode D13, the capacitor voltage VC is applied to the terminal 7, and the transistor T10 may break down. Also, for example, when a short-circuit failure is caused in the diode D0, the transistor T0 may break down. Thus, multi-component failures, such as the secondary failure and the third failure, are caused.

When such multi-component failure is caused, there is no guarantee for a normal/proper drive of the injector 2, leading to an engine stop and hindrance of the vehicle travel.

Further, for example, for the prevention of the multi-component failure, the drive of the injector 2 may be forcefully stopped when an excessive capacitor voltage VC exceeding the predetermined value is detected. However, simply stopping the drive of the injector 2 will lead to the same result. In other words, when the open failure is caused in the transistor T12, the capacitor voltage VC immediately exceeds the above-mentioned predetermined value, causing a forced stop of the drive of the injector 2, which also stops the engine and the travel of the vehicle is hindered.

Therefore, as described above, when the transistor T12 suffers from the open failure, an abnormal rise of the capacitor voltage VC is immediately caused if no action is taken, and the drive of the injector 2 is disabled, and the driver of the vehicle has no way of performing a retreat travel of the vehicle into a safe/non-hazardous place.

In order not to be involved in the above-described problematic situation, in the ECU 1, the fail-safe controller 37*c* is provided.

Next, the operation of the fail-safe controller 37*c* is described with reference to FIG. 5.

Figure 5:
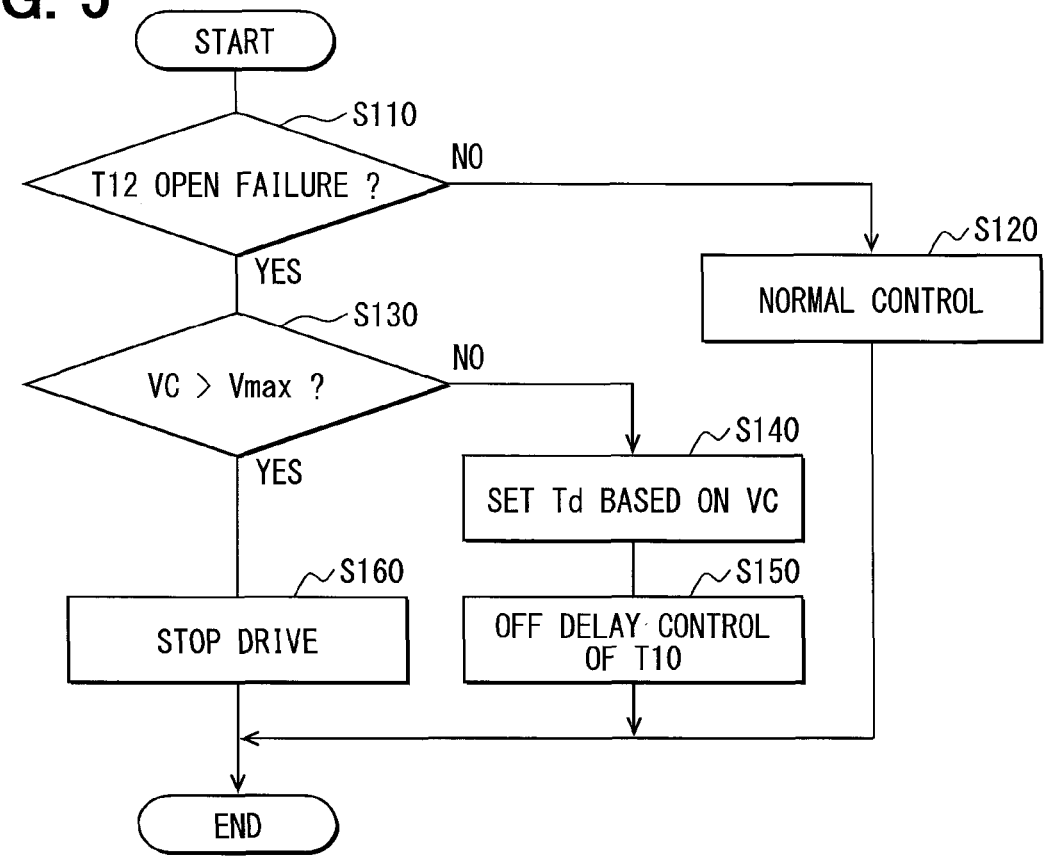
FIG. 5 is a flowchart of an operation of a fail-safe control part in the first embodiment of the present disclosure.

As shown in FIG. 5, the fail-safe controller 37*c* determines whether an open failure is caused in the transistor T12 (S110). For example, the fail-safe controller 37*c* determines whether an input voltage from the voltage division circuit 38 is equal to or higher than a predetermined threshold value during a time when the driving signal from the drive control circuit 37 to the transistor T12 has an active level, which switches ON the transistor T12. Then, when the fail-safe controller 37*c* determines that the input voltage from the voltage division circuit 38 is equal to or higher than the threshold value, the controller 37*c* determines that the transistor T12 is normally switched ON, and when the fail-safe controller 37*c* determines that the input voltage from the voltage division circuit 38 is not equal to or higher than the threshold value, the controller 37*c* determines that the transistor T12 has an open failure.

When the fail-safe controller 37*c* has determined that the transistor T12 is normally operated (i.e., an open failure is not caused) (S110:NO), the controller 37*c* allows the electric current controller 37*b* to perform a normal control operation (S120). The normal control operation is an operation described with reference to FIG. 2.

On the other hand when the fail-safe controller 37*c* has determined that the transistor T12 has an open failure (S110:YES), the controller 37*c* determines, based on the input voltage from the voltage division circuit 38, whether the capacitor voltage VC exceeds a predetermined value Vmax (S130). The predetermined value Vmax may be set to the above-mentioned tolerance voltage (e.g., a breakdown voltage of the diodes D0, D13), or may be set to a predetermined value that is smaller than such a breakdown voltage by a margin.

Further, when the fail-safe controller 37*c* has determined that the capacitor voltage VC has not exceeded the predetermined value Vmax (S130:NO), the fail-safe controller 37*c* sets up a delay time Td based on an actually-detected capacitor voltage VC (S140).

Figure 7:
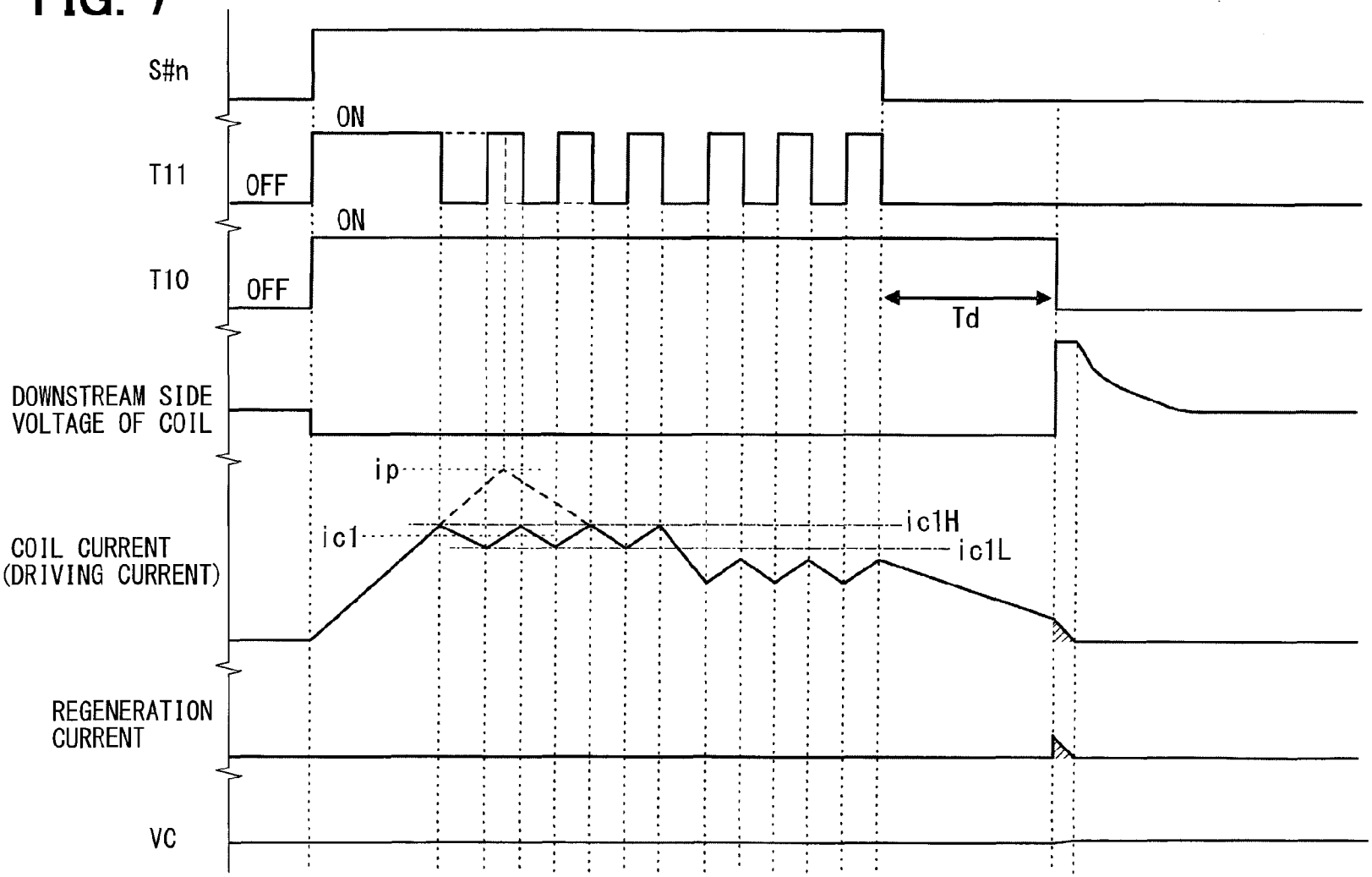
FIG. 7 is a first explanation diagram of an effect in the first embodiment of the present disclosure.

The delay time Td is, as shown in FIG. 7, a delay of an OFF timing of the transistor T10 delayed from a timing when the injection instruction signal S#n is switched to LOW level (i.e., from the end timing of the electricity supply which is set by the microcomputer 39). The fail-safe controller 37*c* sets a longer delay time Td in proportion to a highness (i.e., amount, level, or magnitude) of the capacitor voltage VC.

Figure 6:
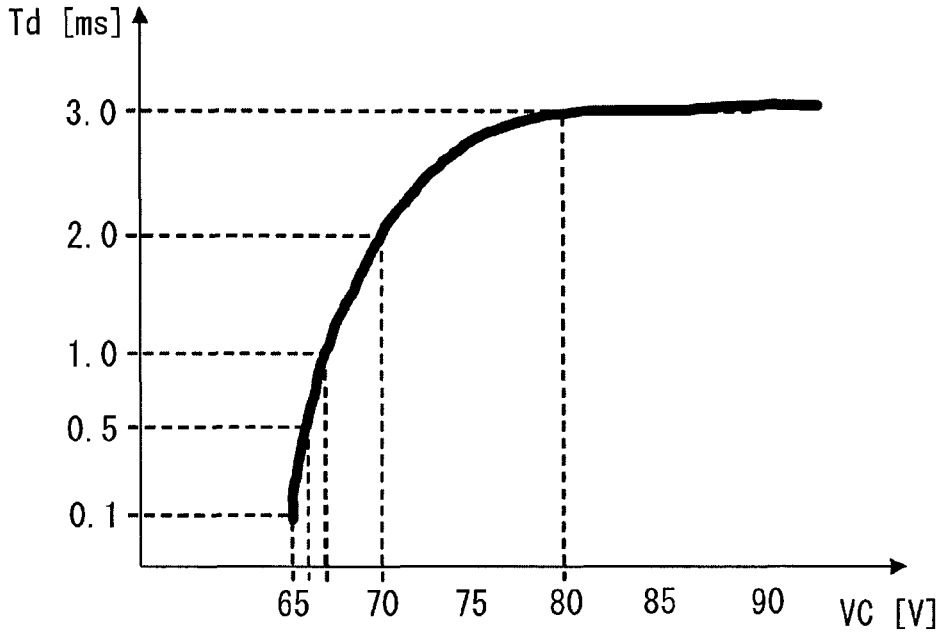
FIG. 6 is a diagram of a data map in which a relationship between a capacitor voltage and a delay time is shown.

For example, the drive control circuit 37 may have a memory, and a data map shown in FIG. 6 representing a relationship between the capacitor voltage VC and the delay time Td may be memorized in the memory. The fail-safe controller 37*c* may read, from the data map, the value of the delay time Td corresponding to the actual capacitor voltage VC, and sets the read value as the delay time Td to be used for a control of the transistor T10. As an alternative configuration, the fail-safe controller 37*c* may select one of many preset delay times Td respectively set to correspond to VC voltage ranges. In such a configuration, a complex calculation/information-processing is saved.

Then, the fail-safe controller 37*c* allows the electric current controller 37*b* to perform an OFF delay control operation, which replaces the normal control operation of FIG. 2 (S150). The OFF delay control operation of the transistor T10 is different from the normal control operation in that "an OFF timing of the transistor T10 is delayed from a timing of switching the injection instruction signal S#n to LOW level by a delay time Td that is set by the fail-safe controller 37*c*. Further, when the fail-safe controller 37*c* detects an open failure of the transistor T12, the fail-safe controller 37*c* may allow the electric current controller 37*b* to perform the special mode of control mentioned above regarding a first-time switch ON of the transistor T11.

On the other hand, the fail-safe controller 37*c* allows the electric current controller 37*b* to stop the drive of the transistors T10, T11, and T12 (S160), when the fail-safe controller 37*c* determines that the capacitor voltage VC exceeds the predetermined value Vmax (S130:YES). That is, the drive of the injector 2 is forcefully stopped irrespective of the injection instruction signal S#n.

The determination results by the fail-safe controller 37*c* (e.g., the transistor T12 having an open failure, the capacitor voltage VC exceeding the predetermined value Vmax, and the like) may be transmitted to the microcomputer 39 from the drive control circuit 37 as determination result information. When configured in the above-described manner, it is not necessary for the microcomputer 39 to perform a process for outputting the injection instruction signal S#n, etc., in case that the drive of the injector 2 is forcefully stopped by the drive control circuit 37. Further, the microcomputer 39 may be able to light a warning lamp or other similar processes upon detecting an open failure of the transistor T12.

The drive control circuit 37 in the ECU 1 of the present embodiment is provided with the above-mentioned fail-safe control parts 37*c*. Therefore, the drive control circuit 37 drives the injector 2 only by the battery voltage VB when an open failure of the transistor T12 is detected, with a delay of the OFF timing of the transistor T10 delayed from the switch timing of the injection instruction signal S#n switched to LOW level, by the delay time Td.

Therefore, by such a delay of the OFF timing, the flyback energy (i.e., the regeneration current) collected via the diode D13 to the capacitor C0 at the end timing of the electricity supply to the coil 2*a* decreases.

In other words, by keeping an ON state of the transistor T10 for the delay time Td after the switching of the injection instruction signal S#n to LOW level, due to a fulfillment of the two conditions, i.e., (i) "the transistor T10=ON" and (ii) "the transistor T11=OFF" for such a delay time Td, the electric current flows back to the coil 2*a* via the diode D12. Then, by such a flow back of the electric current, the energy stored in the coil 2*a* is consumed and the coil current at the time of switching OFF of the transistor T10 is reduced to be very small in comparison to a FIG. 3 situation. Therefore, when the transistor T10 is switched OFF, the flyback energy will not be generated by the coil 2*a* any more, or the flyback energy, if ever generated by the coil 2*a*, will controlled to be nominal. This is the reason why the regeneration current in FIG. 7 is smaller than the regeneration current in FIG. 3.

Figure 8:
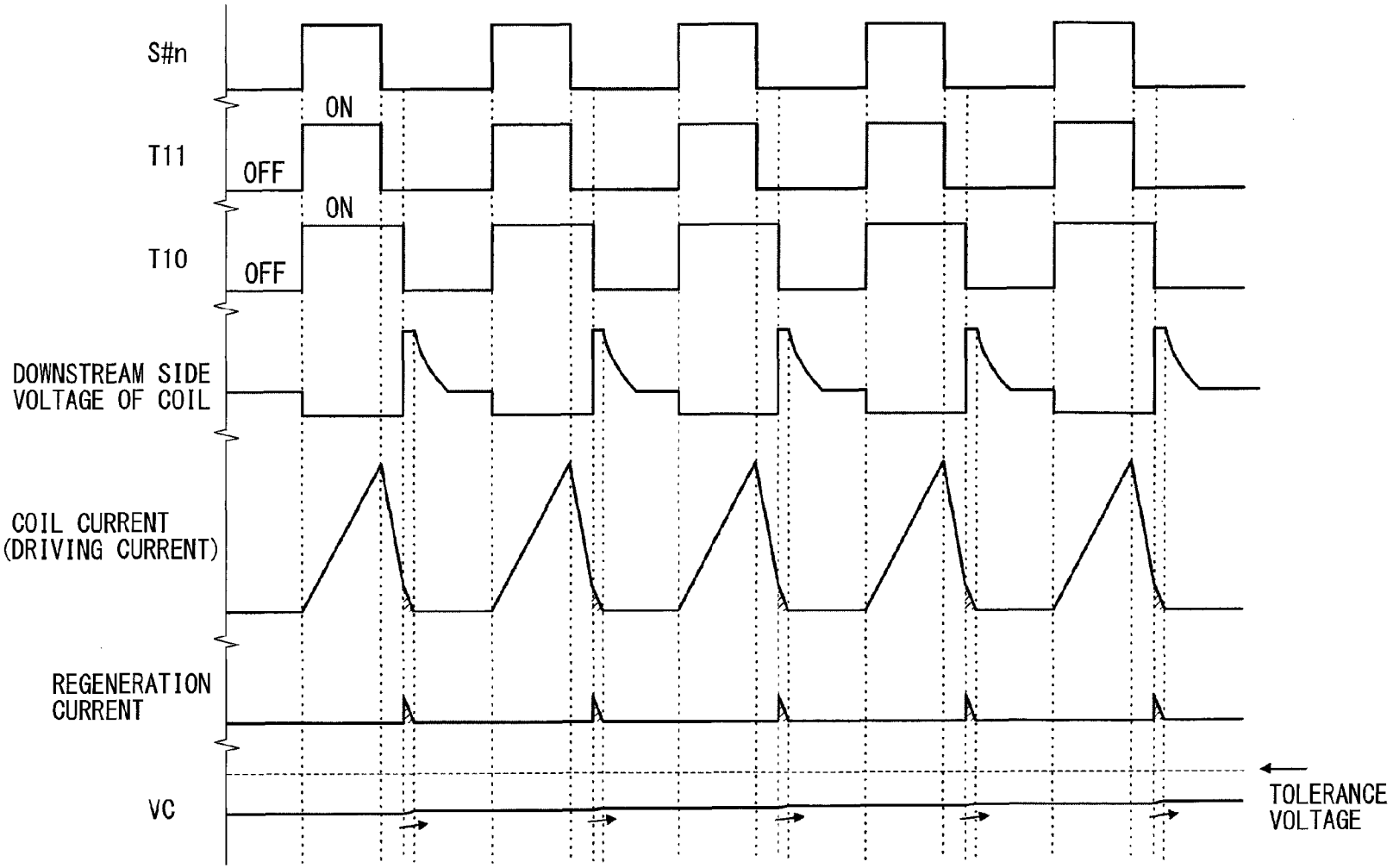
FIG. 8 is a second explanation diagram of an effect in the first embodiment of the present disclosure.

Therefore, according to the ECU 1 in the present embodiment, when an open failure is caused in the transistor T12, the flyback energy collected to the capacitor C0 is reduced. Thus, as shown in FIG. 8, even when the drive of the injector 2 is repeated with the transistor T12 being in the open failure state, the excess of the capacitor voltage VC exceeding the above-mentioned tolerance voltage is prevented. Further, even in case that the capacitor voltage VC continues to go up, the speed of voltage increase is suppressed to be very low.

Therefore, without causing the multi-component failure mentioned above, the drive of the injector 2 is continued for a long time, which enables the retreat travel of the vehicle. Further, there is no need to add a circuit for a forceful discharge of the capacitor C0.

Further, in FIG. 7, the dotted line wave form in the "coil current" row represents the coil current at the time of performing the special mode of control mentioned above by the electric current controller 37*b* when the fail-safe controller 37*c* detects an open failure of the transistor T12. As mentioned above, when the special mode of control is performed as mentioned above, the delay of the valve-opening response of the injector 2 due to the open failure of the transistor T12 is reduced.

Further, in the present embodiment, since the delay time Td is changed according to the capacitor voltage VC, the delay time Td is optimized.

In particular, in the present embodiment, the delay time Td is set to be a longer time as the capacitor voltage VC increases. Therefore, the rise of the capacitor voltage VC and the influence on the fuel injection control from the delay of the OFF timing of the transistor T10 are suppressed/prevented at the same time without compromise.

In other words, in case that the capacitor voltage VC is low, by setting the delay time Td to a shorter period of time, the transistor T10 is switched OFF before the next fuel injection start timing even when a fuel injection interval is short. In an alternative case that the capacitor voltage VC is high, by setting the delay time Td to a longer period of time, the flyback energy collected to the capacitor C0 is reduced further, and the rise of the capacitor voltage VC is controlled further, or is prevented.

In the present embodiment, when the drive control circuit 37 (i.e., the fail-safe controller 37*c*) determines that the capacitor voltage VC has exceeded the predetermined value Vmax, it forcefully stops the drive of the injector 2 (S130: YES, S160). Therefore, in case that the transistor T12 suffers from the open failure, even when the capacitor voltage VC goes up little by little, the multi-component failure of the circuit element is securely prevented. Further, even in such a case, the number of fuel injection times after the open failure of the transistor T12 until a forced stop of the drive of the injector 2 is increased to a very large value, thereby reserving a time for a retreat travel of the vehicle.

On the other hand, as a modification of the above, the delay time Td may be a fixed amount of time. For example, when the delay time Td is set to a time period that allows the regeneration current to the capacitor C0 to be decreased to 0, the rise of the capacitor voltage VC at the open failure time of the transistor T12 is diminished.

Second Embodiment

In the second embodiment, the ECU is described with the same numeral "1" as the first embodiment assigned thereto. Besides, other components same as the first embodiment also have the same numerals.

Figure 9:
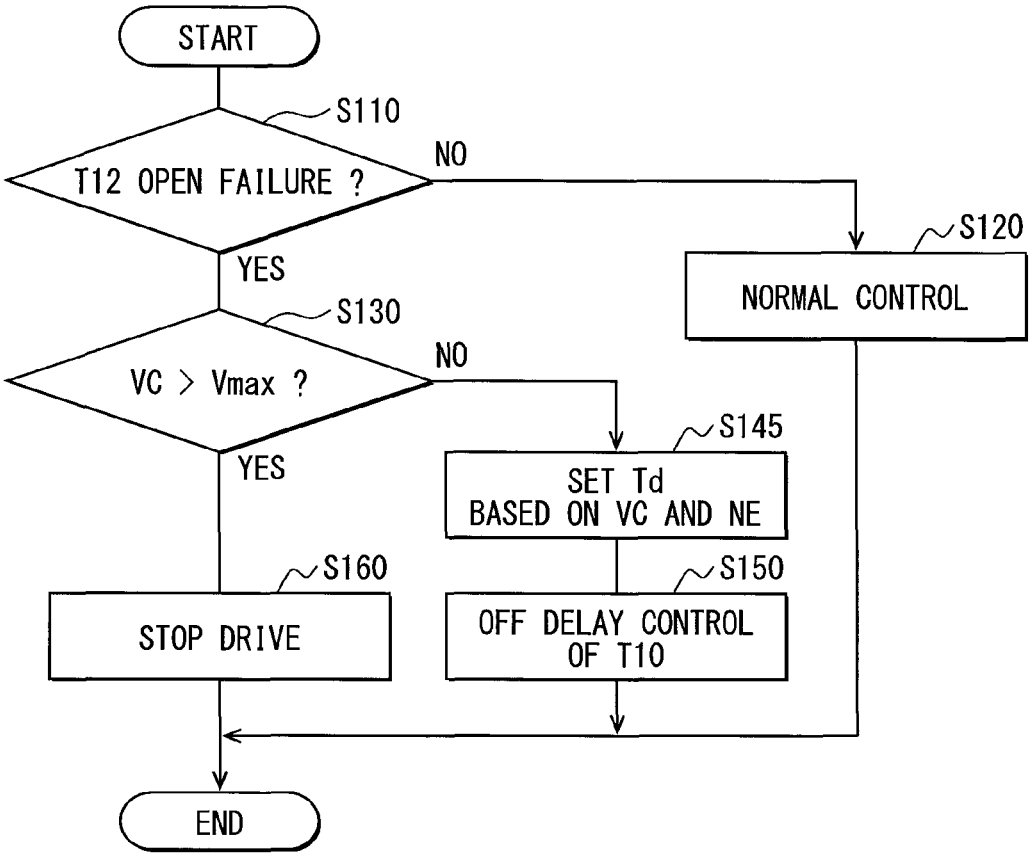
FIG. 9 is a flowchart of the operation of the fail-safe control part in the second embodiment of the present disclosure.

As compared with the ECU 1 in the first embodiment, the fail-safe controller 37*c* of the drive control circuit 37 in the ECU 1 of the second embodiment performs the operation shown in FIG. 9, instead of performing the operation in FIG. 5. In the operation in FIG. 9, step S145 replaces step S140 of FIG. 5.

In other words, the fail-safe controller 37*c* sets the delay time Td based on both of the capacitor voltage VC and an engine rotation speed NE (S145).

For example, in the memory of the drive control circuit 37, a data map is stored for the setting of the delay time Td. In such a data map, regarding the capacitor voltage VC, the higher the capacitor voltage VC is, the delay time Td is defined as a longer period, and regarding the engine rotation speed NE, the higher the engine rotation speed NE is, the delay time Td is defined as a shorter period. Thus, the fail-safe controller 37*c* reads, from the data map, a value of the delay time Td corresponding to the actually-detected capacitor voltage VC and engine rotation speed NE, and sets the read value as the delay time Td that is used for a control of the transistor T10.

According to such an ECU 1 in the second embodiment, in addition to the effect by the ECU 1 of the first embodiment, the delay time Td is optimized in consideration of the engine rotation speed NE.

In other words, the quantity of drive times per-unit-time (i.e., number or amount of drive times per-unit-time) of the injector 2 increases according to an increase of the engine rotation number, which means that a driving interval of the injector 2 (i.e., a fuel injection interval) is decreased/shortened. Thus, according to the ECU 1 of the second embodiment, when the engine rotation speed NE is high, the delay time Td is shortened and the transistor T10 is switched OFF before the start of the next fuel injection (i.e., before the start of driving of the injector 2). Further, when the engine rotation speed NE is low, by setting a longer period for the delay time Td, the rise of the capacitor voltage VC is further controlled, or is prevented. In such a case, the delay time Td may also be set according solely to the engine rotation speed NE.

Although the present disclosure has been fully described in connection with preferred embodiment thereof with reference to the accompanying drawings, it is to be noted that various changes and modifications become apparent to those skilled in the art. Further, the above-mentioned numerical value may only be an example and other values may also be adoptable.

For example, the electro-magnetic valve of a driving object may be not only the injector 2 but also an electro-magnetic valve for an adjustment of injection amount in a fuel feed pump which feeds a high-pressure fuel to the injector 2, for example. In such a case, similar to the injector 2, as the engine rotation number becomes higher, the quantity (i.e., number or amount) of drive times per unit time increases, similar to the first embodiment.

Further, the fail-safe controller 37*c* configured to perform the operation of S130 and S160 in FIG. 5 and FIG. 9 at the time of detecting the open failure of the transistor T12 in the above-mentioned embodiment may be modified to perform the operation of S130 and S160 without regard to the detection result of the open failure of the transistor T12.

Further, functions described as being possessed by one component in the above embodiment may be distributed to be performed by plural components, or functions possessed by respectively different plural components may be performed by only one component.

More practically, multiple controllers 37*a*, 37*b*, and 37*c* in the drive control circuit 37, i.e., in one component, may be distributed to two or more components, or the microcomputer 39 may perform a part of many functions or an entire set of many functions of the drive control circuit 37.

Further, a part of configuration in the above-mentioned embodiment may be replaced with a publicly-known configuration which has the same function. Further, a part of configuration in the above-mentioned embodiment may be omitted as long as the problem is solvable. Even in such a case, all the modes contained in the technical thought recited in the claims are included in the embodiments of the present disclosure. Further, besides the ECU 1 described above, the present disclosure may also be realizable in various forms, such as a system having the ECU 1 as its component, a program that controls a computer to be serving as the ECU 1, a storage medium storing such a program, a drive method for driving an electro-magnetic valve and the like.

Such changes, modifications, and summarized schemes are to be understood as being within the scope of the present disclosure as defined by appended claims.

What is claimed is:

1. An electro-magnetic valve driver comprising:

an electro-magnetic valve having a coil;

a downstream switch disposed in series at a position on a downstream side of the coil in an electric current path that supplies an electric current to the coil;

a first upstream switch disposed in series at a position between (i) an electricity supply line to which an electricity supply voltage is applied and (ii) an upstream side of the coil in the electric current path;

a capacitor storing an electric energy that is discharged to the coil;

a charger charging electricity for the capacitor to raise a charge voltage of the capacitor to a target voltage that is higher than the electricity supply voltage;

a second upstream switch connecting the capacitor to an upstream side of the coil in the electric current path;

a flowback section flowing the electric current back to the capacitor when the first upstream switch is switched from ON to OFF during a switch ON period of the downstream switch;

an electricity supply time setting section that sets an electricity supply time for supplying the electricity to the coil;

an electric current controller switching the downstream switch to ON during the electricity supply time set by the electricity supply time setting section while (i) supplying a peak electric current from the capacitor to the coil for a quick operation of the electro-magnetic valve by switching the second upstream switch to ON at a start timing of the electricity supply time, (ii) after supplying the peak electric current, supplying a constant electric current that is smaller than the peak electric current to the coil by (a) switching the second upstream switch to OFF and (b) performing a first upstream switch ON-OFF control, and (iii) after an end timing of the electricity supply time, ending the first upstream switch ON-OFF control and switching the first upstream switch to OFF;

a collector section collecting to the capacitor a flyback energy of the coil generated by a switch OFF of the downstream switch and the first upstream switch;

a failure detector detecting an open failure of the second upstream switch which disables a switch ON of the second upstream switch; and a delay section delaying a switch OFF timing of the downstream switch from the end timing of the electricity supply time by a preset delay time that is changed in proportion to the charge voltage of the capacitor, when the open failure is detected by the failure detector.

2. The electro-magnetic valve driver of claim 1, wherein the delay section increases the delay time to have a longer amount according to a magnitude of the charge voltage.

3. The electro-magnetic valve driver of claim 1, wherein a quantity of drive times per-unit-time of the electro-magnetic valve increases as an engine rotation speed increases, and the delay section changes the delay time according to the engine rotation speed.

4. The electro-magnetic valve driver of claim 3, wherein the delay section shortens the delay time as the engine rotation speed increases.

5. The electro-magnetic value driver of claim 1, further comprising a drive control circuit that includes memory, the memory includes a data map that includes correlation data between the charge voltage of the capacitor and the preset delay time, and a fail-safe controller that is located in the drive control circuit and that includes the delay section, the fail-safe controller configured to retrieve the correlation data from the memory of the drive control circuit and to change the preset delay time in proportion to the charge voltage of the capacitor according to the correlation data.

* * * * *